US008257508B2

(12) United States Patent
Herzog et al.

(10) Patent No.: US 8,257,508 B2
(45) Date of Patent: Sep. 4, 2012

(54) METHOD AND SYSTEM FOR DERIMING CRYOGENIC HEAT EXCHANGERS

(75) Inventors: Karl L. Herzog, Houston, TX (US); Jon M. Mock, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 354 days.

(21) Appl. No.: 12/694,627

(22) Filed: Jan. 27, 2010

(65) Prior Publication Data

US 2011/0036543 A1 Feb. 17, 2011

Related U.S. Application Data

(60) Provisional application No. 61/148,792, filed on Jan. 30, 2009.

(51) Int. Cl.
*B08B 9/00* (2006.01)
*B08B 9/093* (2006.01)
*F28G 1/12* (2006.01)

(52) U.S. Cl. ..... 134/22.12; 134/22.1; 134/22.18; 134/22.19; 134/22.14; 165/95

(58) Field of Classification Search ..... 134/22.1, 134/22.12, 22.14, 22.18, 22.19; 165/95
See application file for complete search history.

(56) References Cited

U.S. PATENT DOCUMENTS

| | | | | | |
|---|---|---|---|---|---|
| 2,499,404 | A | * | 3/1950 | Marsh | 62/54.2 |
| 2,712,730 | A | * | 7/1955 | Spangler | 62/611 |
| 3,152,016 | A | | 10/1964 | Drushella | |
| 3,241,614 | A | * | 3/1966 | Bertness | 166/304 |
| 3,274,789 | A | | 9/1966 | Mitchell | |
| 3,407,052 | A | * | 10/1968 | Huntress et al. | 48/127.3 |
| 3,420,068 | A | * | 1/1969 | Petit | 62/623 |
| 3,718,586 | A | * | 2/1973 | Rollo et al. | 507/259 |
| RE29,424 | E | * | 10/1977 | Bognaes et al. | 62/53.2 |
| RE29,463 | E | * | 11/1977 | Bognaes et al. | 62/53.2 |
| 4,813,986 | A | | 3/1989 | Humble et al. | |
| 4,925,497 | A | | 5/1990 | Thierheimer, Jr. | |
| 5,018,544 | A | * | 5/1991 | Boisture et al. | 134/111 |
| 5,941,691 | A | | 8/1999 | Stephens | |
| 6,470,690 | B1 | * | 10/2002 | Sicherman | 62/48.1 |
| 6,923,007 | B1 | * | 8/2005 | Markham et al. | 62/50.6 |
| 7,043,938 | B2 | | 5/2006 | Narayan et al. | |
| 2007/0175796 | A1 | * | 8/2007 | Mock | 208/208 R |
| 2008/0115529 | A1 | * | 5/2008 | Ransbarger et al. | 62/613 |
| 2008/0115530 | A1 | * | 5/2008 | Mock et al. | 62/620 |
| 2009/0126401 | A1 | * | 5/2009 | Mock et al. | 62/611 |
| 2011/0011127 | A1 | * | 1/2011 | Evans et al. | 62/613 |

* cited by examiner

*Primary Examiner* — Michael Kornakov
*Assistant Examiner* — Katelyn Whatley
(74) *Attorney, Agent, or Firm* — ConocoPhillips Company

(57) ABSTRACT

The invention relates to a method and apparatus relate for the liquefaction of natural gas. In another aspect, the present invention concerns the deriming the interior surfaces of a cryogenic heat exchanger employed in the liquefaction of natural gas. In another aspect, the present invention concerns the utilization of a pump to derim the interior surfaces of a cryogenic heat exchanger.

24 Claims, 1 Drawing Sheet

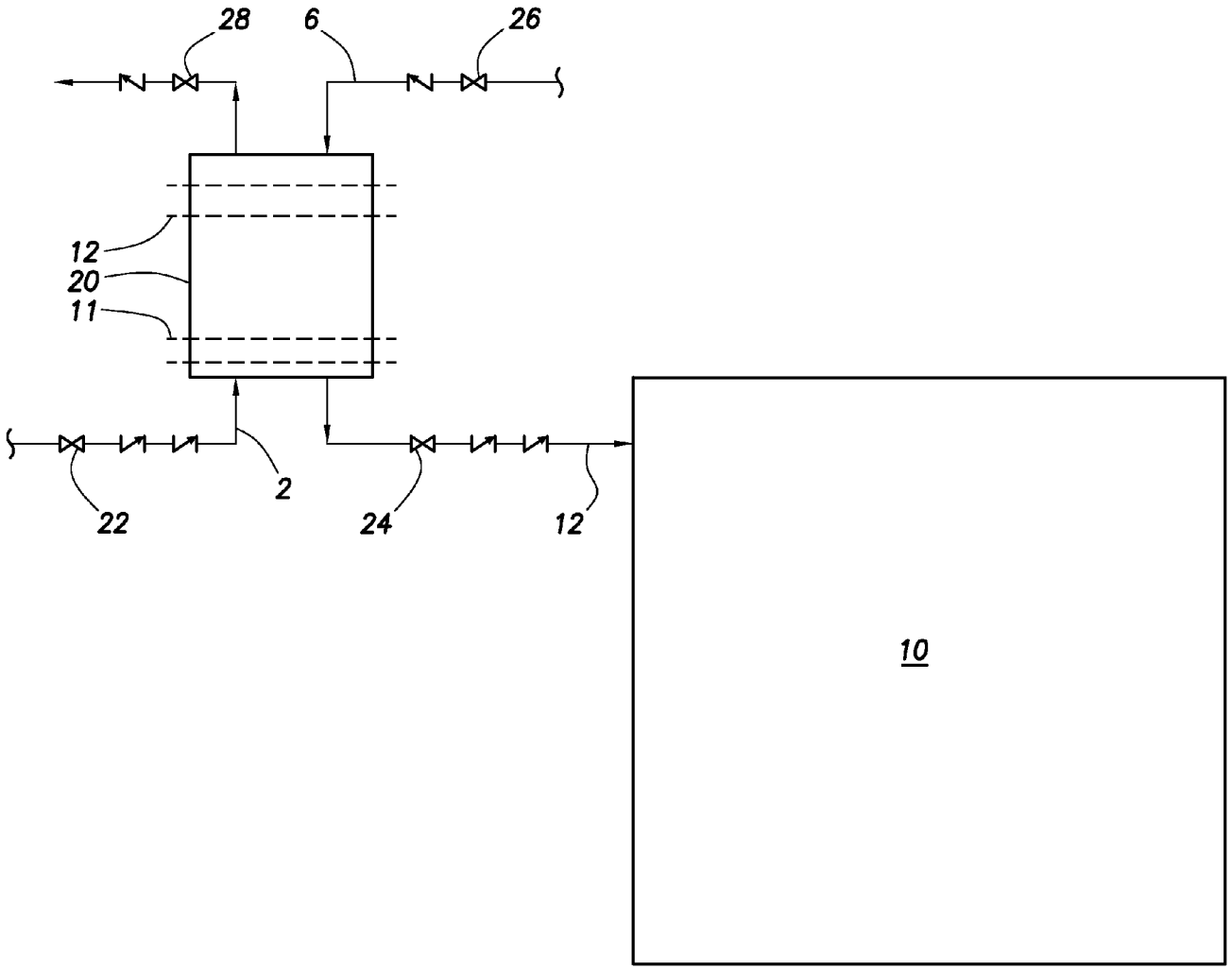
26
6
28
12
20
11
2
22
24
12
10

METHOD AND SYSTEM FOR DERIMING CRYOGENIC HEAT EXCHANGERS

CROSS-REFERENCE TO RELATED APPLICATIONS

This application claims priority benefit under 35 U.S.C. Section 119(e) to U.S. Provisional Patent Ser. No. 61/148,792 filed on Jan. 30, 2009 the entire disclosure of which is incorporated herein by reference.

FIELD OF THE INVENTION

The present invention relates to a method and a system for liquefying natural gas. In another aspect, the present invention concerns a method and a system for enhancing the production of liquefied natural gas.

BACKGROUND OF THE INVENTION

The cryogenic liquefaction of natural gas is routinely practiced as a means of converting natural gas into a more convenient form for transportation and storage. Such liquefaction reduces the volume of the natural gas by about 600-fold and results in a product which can be stored and transported at or near atmospheric pressure.

Natural gas is frequently transported by pipeline from the supply source to a distant market. While it is desirable to operate the pipeline under a substantially constant and high load factor, often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessel. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems).

In any natural gas liquefaction process, there will be progressive accumulation of buildup upon the interior surfaces of the cryogenic heat exchanger. Such buildup can be caused by water in the form of ice or relatively heavy hydrocarbons present in the gas feed in solid form. The various sections of the cryogenic heat exchanger operate at different temperatures depending upon what stream is passing through a particular section. For example, one section of the cryogenic heat exchanger can operate at an inlet temperature of −35° F. and an outlet temperature of −50° F., while a nearby or contiguous section can operate at an inlet temperature of −147° F. and an outlet temperature of −103° F., while yet another nearby or contiguous section in the cryogenic heat exchanger can operate at an inlet temperature of −147° F. and an outlet temperature of −204° F. Thus, it can be seen that a specific stream containing materials having various freeze points may pass through one or more sections of the unit without forming a buildup, but the same stream may encounter a separate section operating at a lower temperature than the other section(s), and buildup can ultimately result thus adversely affecting the overall heat transfer efficiency of the unit. Buildup of solids in these cryogenic heat exchangers, control valves and other associated equipment can lead to reduced heat transfer, high pressure drop and/or reduced flow resulting in a decrease in LNG production.

Therefore, a need exists for the removal, or de-riming, of heavy hydrocarbons that precipitate, wax up or freeze in the passages of cryogenic heat exchangers, control valves and other associated equipment.

SUMMARY OF THE INVENTION

In an embodiment of the present invention, a method of removing buildup in a heat exchanger, the method includes: (a) closing a first inlet valve of pumping vessel, wherein the first inlet valve controls a supply of a solvent into the pumping vessel, wherein the pumping vessel is a positive displacement pumping vessel, wherein the solvent is liquid petroleum gas; (b) closing a first exit valve of the pumping vessel, wherein the first exit valve controls a supply of a solvent exiting the pumping vessel; (c) closing a second inlet valve of the pumping vessel, wherein the second inlet valve controls a supply of a method gas into the pumping vessel, wherein the method gas is capable of exiting with the solvent without negatively impacting the integrity of the solvent, wherein the method gas is a high pressure method gas; (d) continuously opening and closing a second exit valve to maintain pressure within the pumping vessel, wherein the second exit valve controls a supply of the method gas exiting the pumping vessel; (e) opening the first inlet valve to introduce the solvent into the pumping vessel, wherein the pumping vessel includes a pumping vessel housing forming a pumping vessel chamber and a moveable float located within the pumping vessel chamber, wherein the moveable float is attached to the pumping vessel chamber by a mechanical linkage; (f) engaging the moveable float by continuously introducing solvent into the pumping vessel chamber until the solvent reaches a predetermined level, wherein upon reaching the predetermined level the mechanical linkage of the moveable float engages to close the first inlet valve, to close the second exit valve, and to open the second inlet valve; (g) opening the first exit valve of the pumping vessel to discharge the solvent, wherein the discharged solvent is injected into the heat exchanger, wherein the solvent is injected into the heat exchanger at a variable rate; (h) closing the first exit valve of the pumping vessel; and (i) closing the second inlet valve of the pumping vessel.

In another embodiment of the present invention, a method of removing buildup in a heat exchanger, the method includes: (a) closing a first inlet valve of pumping vessel, wherein the first inlet valve controls a supply of a solvent into the pumping vessel; (b) closing a first exit valve of the pumping vessel, wherein the first exit valve controls a supply of a solvent exiting the pumping vessel; (c) closing a second inlet valve of the pumping vessel, wherein the second inlet valve controls a supply of a method gas into the pumping vessel; (d) continuously opening and closing a second exit valve to maintain pressure within the pumping vessel, wherein the second exit valve controls a supply of the method gas exiting the pumping vessel; (e) opening the first inlet valve to introduce the solvent into the pumping vessel, wherein the pumping vessel includes a pumping vessel housing forming a pumping vessel chamber and a moveable float located within the pumping vessel chamber, wherein the moveable float is attached to the pumping vessel chamber by a mechanical linkage; (f) engaging the moveable float by introducing solvent into the pumping vessel chamber until the solvent reaches a predetermined level, wherein upon reaching the predetermined level the mechanical linkage of the moveable float engages to close the first inlet valve, to close the second exit valve, and to open the second inlet valve; (g) opening the first exit valve of the pumping vessel to discharge the solvent, wherein the discharged solvent is injected into the heat exchanger; (h) closing the first exit valve of the pumping vessel; and (i) closing the second inlet valve of the pumping vessel.

In yet another embodiment of the present invention, a system for removing buildup in a heat exchanger, the system includes: (a) a pumping vessel, wherein the pumping vessel includes: (i) a pump housing forming a pump chamber, (ii) a moveable float located within the pump chamber, wherein the moveable float is attached to the pump chamber by a mechanical linkage, (iii) a first inlet leading into the pump chamber, wherein the first inlet introduces a solvent into the pump chamber, (iv) a first inlet valve for controlling supply of the solvent into the pump chamber, (v) a first exit, wherein the first exit discharges the solvent from the pump chamber, (vi) a first exit valve for controlling the discharge of solvent exiting the pump chamber, (vii) a second inlet leading into the pump chamber, wherein the second inlet introduces a process gas into the pump chamber, (viii) a second inlet valve for controlling supply of the process gas into the pump chamber, (ix) a second exit, wherein the second exit discharges process gas from the pump chamber, (x) a second exit valve for controlling the discharge of solvent exiting the pump chamber; and (b) a heat exchanger, wherein the first exit and the first exit valve are between the pumping vessel and the heat exchanger, and wherein the heat exchanger is configured to receive the solvent.

BRIEF DESCRIPTION OF THE DRAWINGS

The present invention is shown by way of example and not by limitation in the accompanying figures, in which:

FIG. 1 is a schematic diagram of one embodiment of the deriming process according to the present invention.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variations can be made in the present invention without departing from the scope or spirit of the invention. For instance, features illustrated or described as part of one embodiment can be used in another embodiment to yield a still further embodiment. Thus, it is intended that the present invention cover such modifications and variations that come within the scope of the appended claims and their equivalents.

A cascaded LNG process uses one or more refrigerant systems for sequentially transferring heat energy from the natural gas stream to the environment where different refrigeration systems may use different refrigerants. Each refrigeration system functions as a heat pump by removing heat energy from the natural gas stream as the stream is progressively cooled to lower and lower temperatures. In so doing, the thermal energy removed from the natural gas stream is ultimately rejected (pumped) to the environment via energy exchange with one or more refrigerants.

The design of a cascaded refrigeration process involves the balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment and the proper selection of flow rates through such equipment so as to ensure that both flow rates and approach and outlet temperatures are compatible with the required heating/cooling duty.

One of the most efficient and effective means of liquefying natural gas is via an optimized cascade-type operation in combination with expansion-type cooling. Such a liquefaction process is comprised of the sequential cooling of a natural gas stream at an elevated pressure, for example about 625 psia, by passage through a multistage propane cycle, a multistage ethane or ethylene cycle, and an open-end methane cycle which utilizes a portion of the feed gas as a source of methane and which includes therein a multistage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the term "propane chiller" shall denote a cooling system that employs a refrigerant having a boiling point the same as, or similar to, that of propane or propylene. As used herein, the term "ethylene chiller" shall denote a cooling system that employs a refrigerant having a boiling point the same as, or similar to, that of ethane or ethylene. As used herein, the terms "upstream" and "downstream" shall be used to describe the relative positions of various components of a natural gas liquefaction plant along the flow path of natural gas through the plant.

Various pretreatment steps provide a means for removing undesirable components, such as acid gases, mercaptan, mercury, and moisture from the natural gas feed stream delivered to the facility. The composition of this gas stream may vary significantly. As used herein, a natural gas stream is any stream principally comprised of methane which originates in major portion from a natural gas feed stream, such feed stream for example containing at least 85 percent methane by volume, with the balance being ethane, higher hydrocarbons, nitrogen, carbon dioxide and a minor amounts of other contaminants such as mercury, hydrogen sulfide, and mercaptan. The pretreatment steps may be separate steps located either upstream of the cooling cycles or located downstream of one of the early stages of cooling in the initial cycle. The following is a non-exclusive listing of some of the available means which are readily available to one skilled in the art: (1) acid gases and to a lesser extent mercaptan are routinely removed via a sorption process employing an aqueous amine-bearing solution; (2) a major portion of the water is routinely removed as a liquid via two-phase gas-liquid separation following gas compression and cooling upstream of the initial cooling cycle and also downstream of the first cooling stage in the initial cooling cycle; (3) mercury is routinely removed via mercury sorbent beds and (4) residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure, that being a pressure greater than 500 psia, preferably about 500 psia to about 900 psia, still more preferably about 500 psia to about 675 psia, still yet more preferably about 600 psia to about 675 psia, and most preferably about 625 psia. The stream temperature is typically near ambient to slightly above ambient. A representative temperature range being 60° F. to 138° F.

As previously noted, the natural gas feed stream is cooled in a plurality of multistage (for example, three) cycles or steps by an indirect heat exchange with a plurality of refrigerants, preferably three. As used herein, the term "heat exchanger" broadly means any device capable of transferring heat from one media to another media, including particularly any structure, e.g., device commonly referred to as a heat exchanger. Thus, the heat exchanger may be a plate-fin, shell-and-tube, spiral core-in-kettle or any other type of heat exchanger. Preferably, the heat exchanger is a brazed aluminum plate-fin type. The overall cooling efficiency for a given cycle improves as the number of stages increases but this increase in efficiency is accompanied by corresponding increases in net capital cost and process complexity. The feed gas is preferably passed through an effective number of refrigeration stages, nominally two, preferably two to four, and more preferably three stages, in the first closed refrigeration cycle utilizing a relatively high boiling refrigerant. Such refrigerant is preferably comprised in major portion of propane, propylene or mixtures thereof, more preferably the refrigerant comprises at least about 75 mole percent propane, even more preferably at least 90 mole percent propane, and most preferably the refrigerant consists essentially of propane.

Thereafter, the processed feed gas flows through an effective number of stages, nominally two, preferably two to four, and more preferably two or three, in a second closed refrigeration cycle in heat exchange with a refrigerant having a lower boiling point. Such refrigerant is preferably comprised in major portion of ethane, ethylene or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is combined with one or more recycle streams (i.e., compressed open methane cycle gas streams) at various locations in the second cycle thereby producing a liquefaction stream. In the last stage of the second cooling cycle, the liquefaction stream is condensed (i.e., liquefied) in major portion, preferably in its entirety thereby producing a pressurized LNG-bearing stream. Generally, the process pressure at this location is only slightly lower than the pressure of the pretreated feed gas to the first stage of the first cycle.

Generally, the natural gas feed stream will contain such quantities of $C_2$+ components so as to result in the formation of a $C_2$+ rich liquid in one or more of the cooling stages. This liquid is removed via gas-liquid separation means, preferably one or more conventional gas-liquid separators. Generally, the sequential cooling of the natural gas in each stage is controlled so as to remove as much as possible of the $C_2$ and higher molecular weight hydrocarbons from the gas to produce a gas stream predominating in methane and a liquid stream containing significant amounts of ethane and heavier components. An effective number of gas/liquid separation means are located at strategic locations downstream of the cooling zones for the removal of liquid streams rich in $C_2$+ components. The exact location and number of gas/liquid separation means, preferably conventional gas/liquid separators, will be dependant on a number of operating parameters, such as the $C_2$+ composition of the natural gas feed stream, the desired BTU content of the LNG product, the value of the $C_2$+ components for other applications and other factors routinely considered by those skilled in the art of the LNG plant and gas plant operation. The $C_2$+ hydrocarbon stream or streams may be demethanized via a single stage flash or a fractionation column. In the latter case, the resulting methane-rich stream can be directly returned at pressure to the liquefaction process. In the former case, the methane-rich stream can be repressurized and recycled or can be used as fuel gas. The $C_2$+ hydrocarbon stream or streams or the demethanized $C_2$+ hydrocarbon stream may be used as fuel or may be further processed such as by fractionation in one or more fractionation zones to produce individual streams rich in specific chemical constituents (e.g., $C_2$, $C_3$, $C_4$ and $C_5$+).

The pressurized LNG-bearing stream is further cooled in a third cycle or step referred to as the open methane cycle via contact in a main methane economizer with flash gases (i.e., flash gas streams) generated in this third cycle in a manner to be described later and via expansion of the pressurized LNG-bearing stream to near atmospheric pressure. The flash gasses used as a refrigerant in the third refrigeration cycle are preferably comprised in major portion of methane, more preferably the refrigerant comprises at least about 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is cooled via at least one, preferably two to four, and more preferably three expansions where each expansion employs as a pressure reduction means either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash step will frequently more than off-set the more expensive capital and operating costs associated with the expander. In one embodiment, additional cooling of the pressurized LNG-bearing stream prior to flashing is made possible by first flashing a portion of this stream via one or more hydraulic expanders and then via indirect heat exchange means employing said flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

When the pressurized LNG-bearing stream, preferably a liquid stream, entering the third cycle is at a preferred pressure of about 550-650 psia, representative flash pressures for a three stage flash process are about 170-210, 45-75, and 10-40 psia. Flashing of the pressurized LNG-bearing stream, preferably a liquid stream, to near atmospheric pressure produces an LNG product possessing a temperature of about −240° F. to −260° F.

The liquefaction process may use one of several types of cooling which include but is not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A platefin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Finally, expansion or pressure reduction cooling refers to cooling which occurs when the pressure of a gas, liquid or a two-phase system is decreased by passing through a pressure reduction means. In one embodiment, this expansion means is a Joule-Thomson expansion valve. In another embodiment, the expansion means is either a hydraulic or gas expander. Because expanders recover work energy from the expansion process, lower process stream temperatures are possible upon expansion.

As previously discussed the present invention focuses on the removal or deriming of the progressive accumulation of buildup, such as water in the form of ice and relatively heavy hydrocarbons present in the gas feed in solid form, upon the interior surfaces of the cryogenic heat exchanger.

Referring to FIG. 1, a pumping vessel 20 provides a mechanism for injecting solvent into the cryogenic heat exchanger 10. The pumping vessel includes a first inlet valve 22 for controlling supply of solvent into the pumping vessel, a first exit valve 24 for solvent exiting the pumping vessel, a second inlet valve 26 for controlling supply of process gas into the pumping vessel, and a second exit valve 28 for process gas exiting the pumping vessel.

The process begins with a minimal amount of solvent in the pump chamber of the pumping vessel. FIG. 1 depicts this minimal amount of solvent via line 11. The first inlet valve 22, the second inlet valve 26, and the first exit valve 24 are all in closed positions, while the process gas exit valve 28 is continuously opening and closing as necessary to maintain appropriate pressure within the pumping vessel 20. The first inlet valve 22 is then open to allow the solvent to enter the pumping vessel 20 via conduit 2 in an effort to fill the vessel. As the pumping vessel 20 chamber fills with solvent, a float within the pump chamber, not pictured, begins to rise as the amount of deriming solvent increases. When the float reaches a predetermined level, level 12 in FIG. 1, the float operates as a snap-action mechanical linkage to close the first valve 22, to then close the second valve 28, and to then open the second inlet valve 26 allowing for entry of the process gas via conduit 6 in an effort to pressurize the vessel. The snap-action mechanical linkage ensures a rapid changeover from filling to pumping. Thus, as the pressure inside the pump increases above the back pressure, the solvent is forced through the first exit valve 24 and injected into the cryogenic heat exchanger 10 via conduit 12. After discharge, the first exit valve 24 is closed followed by the process gas inlet valve 26 thus placing the vessel back in pressure control.

In an embodiment, the pumping vessel 20 is a positive displacement pump. In another embodiment, the pumping vessel is a blowcase. In yet another embodiment, the pumping vessel is a steam condensate pump. In a further embodiment, the pumping vessel is a mechanical pressure powered pump.

The process gas utilized in the pumping vessel is capable of co-existing with the deriming solvent without negatively impacting the integrity of the solvent. In an embodiment, a high pressure process gas is utilized.

As previously discussed, the injection of the solvent into the cryogenic heat exchanger assists in the alleviation and elimination of progressive accumulation of buildup within the cryogenic heat exchanger, while allowing the deriming solvent to be delivered to the cryogenic heat exchanger at a variable rate, i.e., continuous or intermittent injection. In an embodiment, the injection can be provided as a slug for high rate injection, i.e., slug deriming. In another embodiment, the injection can be provided as metered into the system. In an embodiment, if the injection is provided as metered into the system a needle valve can be utilized, or a flow control valve can be utilized or any other control system to provide a relatively constant time-averaged rate of injection for continuous deriming of the heat exchanger.

In an embodiment, the solvent is a deriming solvent. In another embodiment, the solvent is liquid hydrocarbon. In another embodiment, the solvent is liquid petroleum gas (LPG). However, other liquid hydrocarbons which can be expected to be suitable for deriming the interior surfaces of the cryogenic heat exchanger are also of significant importance in the practice of this invention. For example, suitable solvent can include liquefied gas mixtures containing varying fraction of approximately 0.1 to approximately 80 volume percent or higher methane, ethane, propane, butane, pentane and hexane from distillation.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described in the present invention. It is the intent of the inventors that variations and equivalents of the invention are within the scope of the claims below and the description, abstract and drawings not to be used to limit the scope of the invention

The invention claimed is:

1. A method of removing buildup in a heat exchanger, the method comprising:

a. closing a first inlet valve of pumping vessel, wherein the first inlet valve controls a supply of a solvent into the pumping vessel, wherein the pumping vessel is a positive displacement pumping vessel, wherein the solvent is liquid petroleum gas;

b. closing a first exit valve of the pumping vessel, wherein the first exit valve controls a supply of a solvent exiting the pumping vessel;

c. closing a second inlet valve of the pumping vessel, wherein the second inlet valve controls a supply of a method gas into the pumping vessel, wherein the method gas is capable of existing with the solvent without negatively impacting the integrity of the solvent, wherein the method gas is a high pressure method gas;

d. continuously opening and closing a second exit valve to maintain pressure within the pumping vessel, wherein the second exit valve controls a supply of the method gas exiting the pumping vessel;

e. opening the first inlet valve to introduce the solvent into the pumping vessel, wherein the pumping vessel includes a pumping vessel housing forming a pumping vessel chamber and a moveable float located within the pumping vessel chamber, wherein the moveable float is attached to the pumping vessel chamber by a mechanical linkage;

f. engaging the moveable float by continuously introducing solvent into the pumping vessel chamber until the solvent reaches a predetermined level, wherein upon reaching the predetermined level the mechanical linkage of the moveable float engages to close the first inlet valve, to close the second exit valve, and to open the second inlet valve;

g. opening the first exit valve of the pumping vessel to discharge the solvent, wherein the discharged solvent is injected into the heat exchanger, wherein the solvent is injected into the heat exchanger at a variable rate;

h. closing the first exit valve of the pumping vessel; and i. closing the second inlet valve of the pumping vessel.

2. The method according to claim 1, wherein the pumping vessel is a blowcase.

3. The method according to claim 1, wherein the pumping vessel is a steam condensate pumping vessel.

4. The method according to claim 1, wherein the pumping vessel is a pressure powered pumping vessel.

5. The method according to claim 1, wherein the first inlet valve is a needle valve.

6. The method according to claim 1, wherein the first exit valve is a needle valve.

7. The method according to claim 1, wherein the second inlet valve is a needle valve.

8. The method according to claim 1, wherein the second inlet valve is a needle valve.

9. A method of removing buildup in a heat exchanger, the method comprising:

a. closing a first inlet valve of pumping vessel, wherein the first inlet valve controls a supply of a solvent into the pumping vessel;

b. closing a first exit valve of the pumping vessel, wherein the first exit valve controls a supply of a solvent exiting the pumping vessel;

c. closing a second inlet valve of the pumping vessel, wherein the second inlet valve controls a supply of a method gas into the pumping vessel;

d. continuously opening and closing a second exit valve to maintain pressure within the pumping vessel, wherein the second exit valve controls a supply of the method gas exiting the pumping vessel;

e. opening the first inlet valve to introduce the solvent into the pumping vessel, wherein the pumping vessel includes a pumping vessel housing forming a pumping vessel chamber and a moveable float located within the pumping vessel chamber, wherein the moveable float is attached to the pumping vessel chamber by a mechanical linkage;

f. engaging the moveable float by introducing solvent into the pumping vessel chamber until the solvent reaches a predetermined level, wherein upon reaching the predetermined level the mechanical linkage of the moveable float engages to close the first inlet valve, to close the second exit valve, and to open the second inlet valve;

g. opening the first exit valve of the pumping vessel to discharge the solvent, wherein the discharged solvent is injected into the heat exchanger;

h. closing the first exit valve of the pumping vessel; and i. closing the second inlet valve of the pumping vessel.

10. The method according to claim 9, wherein the pumping vessel is a positive displacement pumping vessel.

11. The method according to claim 10, wherein the pumping vessel is a blowcase.

12. The method according to claim 10, wherein the pumping vessel is a steam condensate pumping vessel.

13. The method according to claim 10, wherein the pumping vessel is a pressure powered pumping vessel.

14. The method according to claim 9, wherein the solvent is liquid petroleum gas.

15. The method according to claim 9, wherein the solvent is a liquefied gas including approximately 0.1 to 80 volume percent or higher methane, ethane, propane, butane, pentane, hexane or combinations thereof.

16. The method according to claim 9, wherein the solvent is injected at a variable rate.

17. The method according to claim 16, wherein the solvent is injected continuously into the heat exchanger.

18. The method according to claim 16, wherein the solvent is injected intermittently into the heat exchanger.

19. The method according to claim 9, wherein the method gas is capable of coexisting with the solvent without negatively impacting the integrity of the solvent.

20. The method according to claim 19 wherein the method gas is a high pressure method gas.

21. The method according to claim 9, wherein the first inlet valve is a needle valve.

22. The method according to claim 9, wherein the first exit valve is a needle valve.

23. The method according to claim 9, wherein the second inlet valve is a needle valve.

24. The method according to claim 9, wherein the second inlet valve is a needle valve.

* * * * *